US006011227A

United States Patent [19]

Yoneyama

[11] Patent Number: 6,011,227

[45] Date of Patent: Jan. 4, 2000

[54] PUSH BUTTON SWITCH

[75] Inventor: Masayuki Yoneyama, Fujisawa, Japan

[73] Assignee: Minebea Co., Ltd., Kitasaku, Japan

[21] Appl. No.: 09/244,757

[22] Filed: Feb. 5, 1999

[30] Foreign Application Priority Data

Feb. 6, 1998 [JP] Japan ..... 10-025543

[51] Int. Cl.[7] ..... H01H 13/70

[52] U.S. Cl. ..... 200/344; 200/344; 200/491.1; 200/491.2

[58] Field of Search ..... 200/341–345; 400/491, 491.1, 491.2

[56] References Cited

FOREIGN PATENT DOCUMENTS

| | | |
|---|---|---|
| 0 134 509 | 3/1985 | European Pat. Off. . |
| 0693761 A1 | 1/1996 | European Pat. Off. . |
| 29713719U1 | 10/1997 | Germany . |

*Primary Examiner*—Michael L. Gellner
*Assistant Examiner*—Nhung Nguyen
*Attorney, Agent, or Firm*—Staas & Halsey LLP

[57] ABSTRACT

A push button switch for use in computer keyboards, comprising a membrane sheet 92 whose upper surface forms the switch base plate 90 upon which is mounted a rubber spring 93 which operates the switch, and upon which is arranged a plate-shaped holder member 40 containing a through hole 41, through which the rubber spring 93 projects. Between key top 1, positioned on top of holder member 40, and holder member 40 is arranged moving frame 60 and moving arm 80, assembled in a pantograph assembly. This assembly supports key top 1 so that it can move up and down in relation to membrane sheet 92, and rubber spring 93 biases key top 1 upwards. When key top 1 is pressed downwards, the pressure is transmitted via rubber spring 93 to cause the switch of membrane sheet 92 to operate. When the pressure is released, the resilience of rubber spring 93 raises key top 1 back to its original position.

7 Claims, 6 Drawing Sheets

PUSH BUTTON SWITCH

BACKGROUND OF THE INVENTION

1. Field of the Invention

The present invention relates to a push button switch construction, and especially to a push button switch construction for use in thin keyboards.

2. Description of the Prior Art

Keyboards consisting of a plurality of key switches arranged in a matrix are used as data input devices for personal computers and other kinds of electronic equipment. Conventionally, the type of push button switch used for such keyboards has been of the type illustrated by the example shown in FIG. 6 (laid open no. 6-260053 Japan).

The push button switch shown in FIG. 6 consists of a key top 101 with anchor clamps 102 and 103 on its under surface, guide support members 107 and 108, held in place by said anchor clamps 102 and 103, which support the said key top and allow it to freely move up and down, a holder member 125 which is positioned under the key top and has a clamp 127 to support the lower parts of guide support members 107 and 108, and a switching member 135 which performs the switching action as the key top moves up and down.

The said guide support members 107 and 108 are U-shaped, with their respective arms crossing at the center in an X-shape when viewed from the side, and the members rotate freely around the axis formed by this intersection. One end of guide support member 107 is rotatably supported by anchor clamp 102 on the underside of key top 101, while the other end is held by anchor clamp 126 on holder member 125 in such a way as to allow it to freely slide back and forth. One end of guide support member 108 is held by anchor clamp 103 on the underside of key top 101 in such a way as to allow it to freely slide back and forth, while the other end is rotatably supported by clamp 127 on holder member 125.

Normally, the rubber spring forming the switching member 135 pushes up on the intersection of guide support members 107 and 108, thus keeping key top 101 in the raised position and the push button switch in the off condition. From this position, if downward pressure is applied to key top 101, the pantograph type assembly formed by guide support members 107 and 108 folds and allows the key top to be depressed. As the intersecting part of guide support members 107 and 108 is lowered, it flattens the rubber spring of the switching member 135 and places the push button switch in the on condition. When the downward pressure on key top 101 is released, the resilience of the rubber spring causes guide support members 107 and 108 to return to the position shown in FIG. 6, and the switching member 135 returns to the off condition.

In order for guide support members 107 and 108 to move as described above, a U-shaped anchor clamp groove 105 and a U-shaped sliding groove 132 must be incorporated in the underside of key top 101 and the top side of holder member 125 respectively, into which fit anchor pins 115 and 123 on the ends of guide support members 107 and 108, so that these ends can freely slide back and forth. The construction consists of an assembly comprising guide support members 107 and 108 supported by anchor clamp 103 on the underside of key top 101 and anchor clamp 126 on the top side of holder member 125 so that its ends may freely slide back and forth. This construction means that, when assembling the push button switch, whichever side is assembled first, key top 101 or holder member 125, the side to be assembled last cannot be seen during assembly, which makes assembly very difficult. In addition, when such push button switched are made smaller and thinner, the complex shape of the components makes handling very difficult and increases the time required for assembly. Also, because an anchor groove 105 must be incorporated on the underside of key top 101 in order to allow the end of guide support member 108 to slide freely while supporting the key top, it is difficult to mold many pieces at the same time, and so mass production is not efficient and productivity is low. Similarly, the necessity to mold holder member 125 in a shape providing a slide groove 132 on its upper surface requires a complex die and is a drawback.

SUMMARY OF THE INVENTION

In order to solve the problems described above, this invention provides a construction in which grooves are not required to be formed in both the key top and holder member in order to allow the ends of the guide support members to slide. Instead, the ends of the guide support members themselves provide sliding and rotational support. This provides a push button switch which is easier to produce and to assemble.

This invention, by providing a push button switch construction as described below, eliminates the problems resulting from the conventional technology.

In the invention described in claim 1, a push button switch is provided, in which, by pressing down the key top in opposition to the resilience of the spring mechanism between the key top and the switch substrate, a contact in the switch substrate is caused to operate, and where by the same resilience, the key top is returned to its original position. There is provided a switch substrate which includes the operating contact, and a resilient member closely mounted on the top of the switch substrate. The said resilient member projects through a through hole, around the sides of which hole are provided a holder member having, between the rotatably supporting member and the switch substrate, a slide clamp forming a groove which is U-shaped in cross-section. A supporting axis which allows free rotation is provided on one end of the above mentioned rotatably supporting member, while on the other end is a moving arm with slide pins. A moving frame with, on one end, slide pins which slide in the U-shaped cross section groove formed between the above mentioned rotatably supporting member and the switch substrate, and on the other end a supporting axis, intersects with the aforesaid moving arm to provide rotational support. The U-shaped cross section groove is formed by the space between the key top and the axial support clamp, in which the support axis of the said moving frame is rotatably supported. There is also provided a support plate having a slide clamp to hold and allow to slide the slide pins of the aforementioned moving arm, said support plate being attached to the key top by means of hooks on the underside of the key top.

The invention provides a push button switch where the above mentioned switch substrate comprises a membrane sheet switch mechanism.

The invention provides a push button switch where a moveable contact fitted in the resilient member makes and breaks the connection with a fixed contact mounted in the above mentioned switch substrate.

The invention provides a push button switch in which a single stand-alone push button switch can be manufactured.

The invention provides a push button switch as the switch element when a plurality of key tops are installed in a holder member to form a keyboard.

The invention provides a push button switch where the above mentioned resilient member comprises a rubber spring, cup-shaped in cross section, having a click action.

The invention provides a push button switch where the above mentioned resilient member comprises a spring member which compresses when pressure is applied and returns to its original shape and condition when pressure is released.

DESCRIPTION OF THE PREFERRED EMBODIMENTS

Embodiments of the present invention will now be described in detail with reference to the accompanying drawings.

Figure 1:
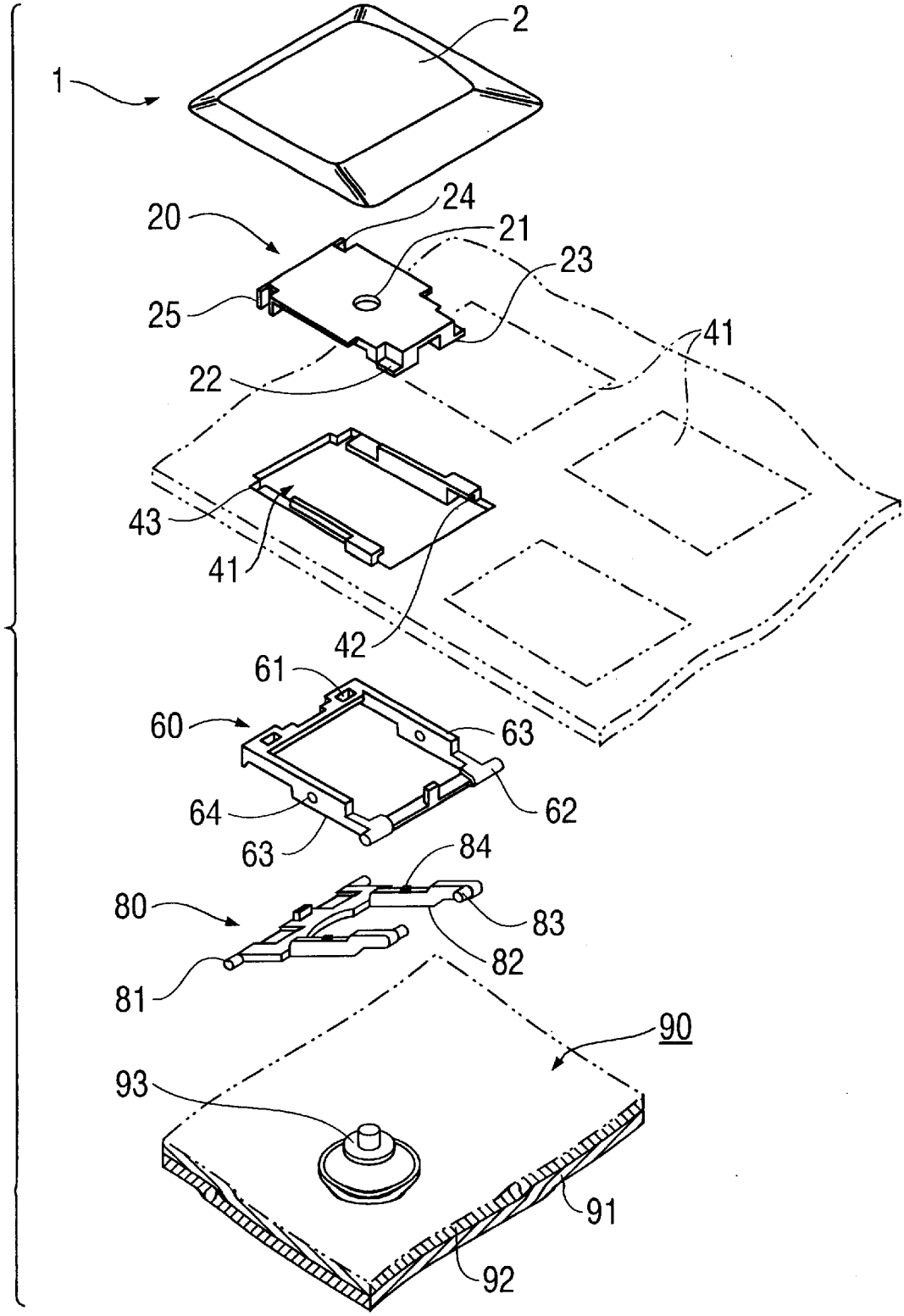
FIG. 1 is an exploded perspective view showing the push button switch of the present invention.

FIG. 1 is an exploded perspective view showing the push button switch of the present invention. The push button switch shown in FIG. 1 consists of a key top 1, a support plate 20, a holder member 40, a moving frame 60, a moving arm 80, and a switch substrate 90.

Figure 2:
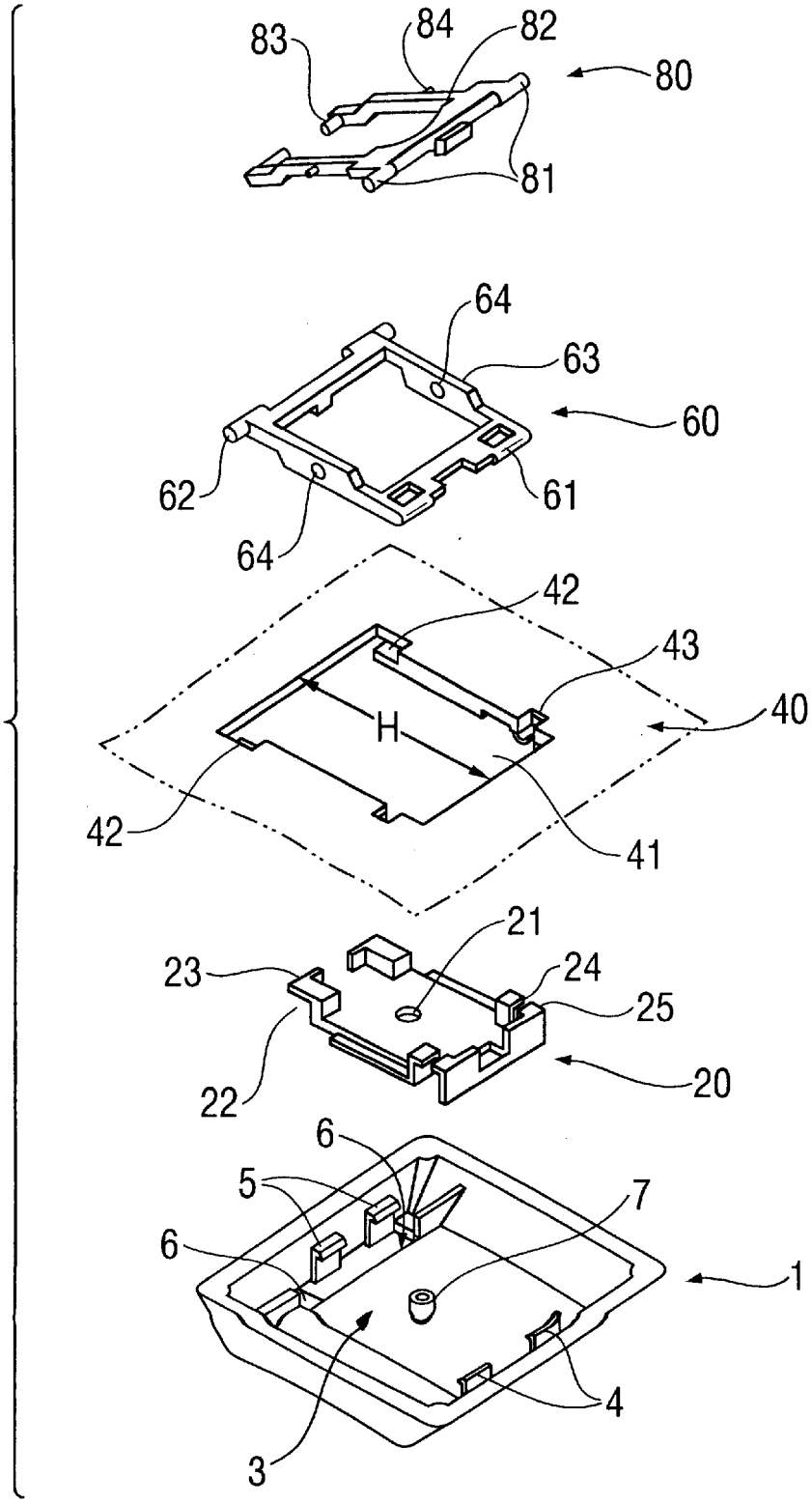
FIG. 2 is an exploded perspective view of the push button switch shown from the underside.

Key top 1 is approximately trapezoid in shape, and on its upper side is formed the operating surface 2 upon which can be printed letters or symbols and which receives the pressure from the operator's finger. FIG. 2 shows an exploded perspective view of the same components as FIG. 1, but from the reverse viewpoint. FIG. 2 shows that a shallow cavity 3 is formed on the underside of key top 1, in which are arranged hooks 4, 4 and 5, 5 which hold in place the supporting plate 20, which will be described in detail hereafter. On either side of the hooks 5, 5 are formed the slide surfaces 6, 6. The protuberance 7 is a positioning guide for fitting the support plate 20.

Support plate 20 is an approximately flat plate shape, in the center of which is formed a round hole 21 for the purpose of aligning the position of key top 1. At the end of slide clamps 22 are shoulders 23 which fit the previously described hooks 5, 5. At the opposite end of the support plate to slide clamps 22 are formed rotatively supporting clamps 24. Rotatably supporting clamps 24 have two small arms which allow the free rotation of support axes 61, 61 formed on moving frame 60, which will be described below. Rotatably supporting clamps 24 have shoulders 25 at one end to fit the previously described hooks 4, 4.

Holder member 40 is formed from a large sheet of plastic. Each sheet contains a plurality of rectangular through holes 41 so that a plurality of push button switches may be arranged on it. Formed in the rim of each through hole 41 are slide clamps 42, 42, which allow slide pins 61 of moving frame 60 to slide, and rotatively supporting clamps 43, 43, which rotatably support the support axis 81 of moving arm 80.

Moving frame 60 is rectangular in shape and, as described above, has support axes 61, 61 and slide pins 62, 62 positioned at its corners, and also has axis holes 64, 64 punched facing each other in arms 63, 63.

Moving arm 80 is roughly U-shaped, and at the end of each arm 82, 82 has slide pins 83, 83 facing each other. Projecting outwards from the center part of each arm 82 are axial support pins 84, 84 which, after assembly, fit into axis holes 64, 64 of moving frame 60 to allow free rotation of moving arm 80 and moving frame 60.

Figure 3:
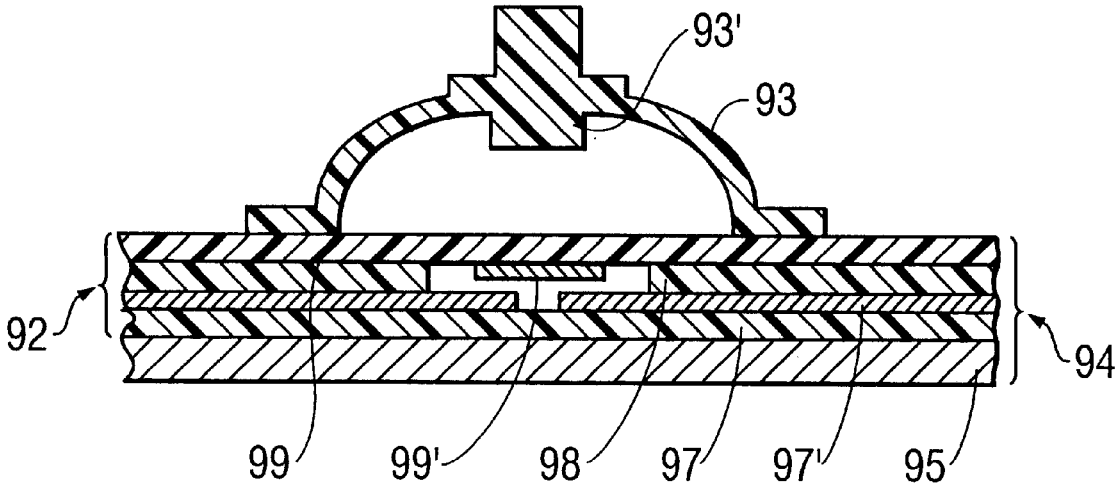
FIG. 3 is a sectional view of the membrane switch.

Switch substrate 90 consists of a rigid plate 91, made from metal or similar, on top of which is positioned a membrane sheet 92, which supports a dome shaped rubber spring 93. FIG. 3 shows how, in switch substrate 94, membrane sheet 92 is laminated on top of the metal or similar base plate 95. Membrane sheet 92 comprises a contact substrate 97, made from an insulating sheet with wiring 97' printed on its upper surface, a spacer 98 made of an insulating sheet, and a moveable plate 99 made from a flexible insulating sheet with a moveable conductor 99' printed on its under surface. When rubber spring 93 is pressed down, the projection 93' on its inside pushes down moveable plate 99 so that moveable conductor 99' makes contact with wiring 97' and the switch mechanism is set to the on condition. When the pressure on rubber spring 93 is released, the resilience of the rubber returns the switch to the condition shown in FIG. 3. Both the depressing and the releasing of the rubber spring 93 are so-called click actions.

In place of the above membrane switch, a switch mechanism may also be used in which a fixed substrate holds a circuit mechanism made from a printed wiring containing a fixed contact on its upper surface, a dome-shaped rubber spring 93 is positioned on the fixed contact of said fixed substrate, and when the key top is pressed down on the top of the rubber spring 93 it collapses causing the moveable contact inside the rubber spring to make contact with the fixed contact on the fixed substrate, thus setting the switch mechanism to the on condition.

The assembly of the push button switch related in the present invention will now be described. First, the ends of arms 82, 82 of moving arm 80 are squeezed together 80 that they can be slid into the inside of moving frame 60, and axial pins 84, 84 are fitted into axial holes 64, 64 so that moving arm 80 and moving frame 60 form a pantograph or X-shaped assembly which can freely rotate. Thus assembled together, moving arm 80 and moving frame 60 are referred to as the pantograph assembly.

Slide pins 83 of moving arm 80 are slid into the slide clamps of support plate 20, and support axis 61 of moving frame 60 is pressed into the rotating clamp sections 24 of support plate 20 to allow free rotation. In this way, the pantograph assembly and the support plate 20 are assembled together so that they project downwards from holder member 40 in the view shown in FIG. 1, and upwards from holder member 40 in the view shown in FIG. 2. The size of support plate 20 is smaller than the size of the through hole 41 in holder member 40, so that it can pass through the hole. Accordingly, moving frame 60 and moving arm 80 can pass through the through hole 41, but slide pins 62 of moving frame 60 fit into stepped slide sections 42 of holder member 40, and support axis 81 of moving arm 80 clips into axial support clamp 43 of holder member 40. Support axis 81 is pressed into axial support clamp 43 to provide rotational support.

Next, alignment protuberance 7 of key top 1 is aligned with circular hole 21 in support plate 20, and key top 1 is pressed forcibly toward support plate 20 so that hooks 4, 4 fit onto shoulders 25, 25 and hooks 5, 5 fit onto shoulders 23, 23 to attach key top 1 to support plate 20. When key top 1 and support plate 20 have been assembled into a single unit, the slide contact surface 6 of key top 1 and the stepped slide section 22 of support plate 20 form a U-shaped groove. Slide pins 83 of moving arm 80 rotatably slide back and forth in this groove.

Figure 4:
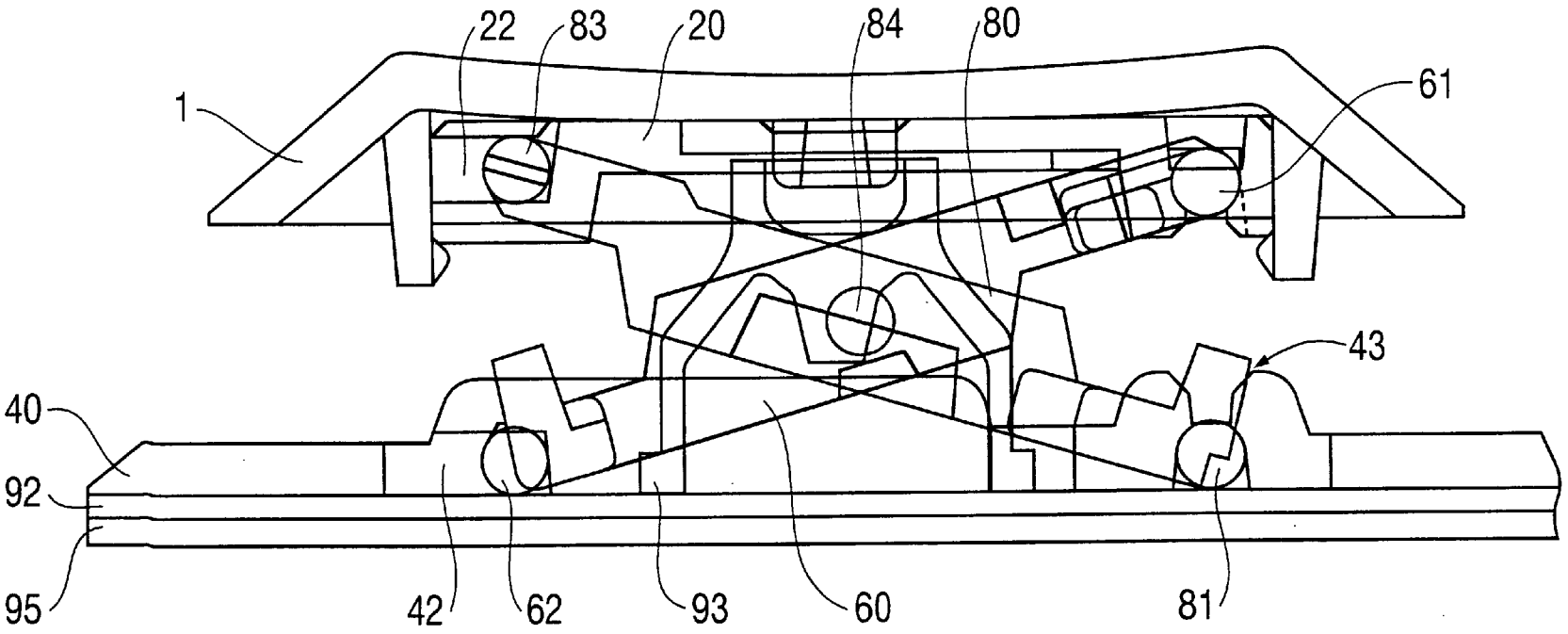
FIG. 4 is a sectional view showing the push button switch in the off condition.

As shown in FIG. 4, switch substrate 90 is provided facing the underside of holder member 40 which supports the key top and pantograph assembly described above. After said switch substrate 90 is aligned with holder member 40, it is fixed firmly in place using screws or some other appropriate fixing process. The rubber spring 93 projects through the through hole 41 of holder member 40 with the top of the rubber spring pushing up on the underside of support plate 20 which supports the key top 1. This results in key top 1 being supported in the raised position. Naturally the switch mechanism is here in the off condition. Further, because switch substrate 90 is closely connected to and parallel with the under surface of holder member 40, support axis 81 of moving arm 80, which is fitted into axial support clamp 43 of holder member 40, is rotatably supported by said axial support clamp 43, and the slide pins 62 of moving frame 60 fit inside the U-shaped groove formed by the slide clamps 42 of holder member 40 and switch substrate 90 allowing them to slide and rotate.

Figure 5:
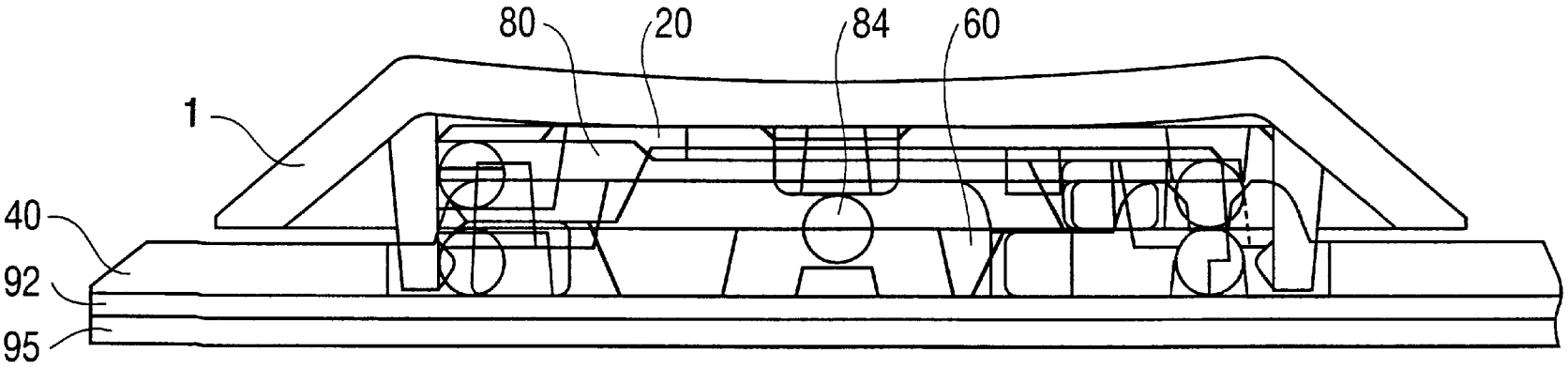
FIG. 5 is a sectional view showing the push button switch in the on condition.
Figure 6:
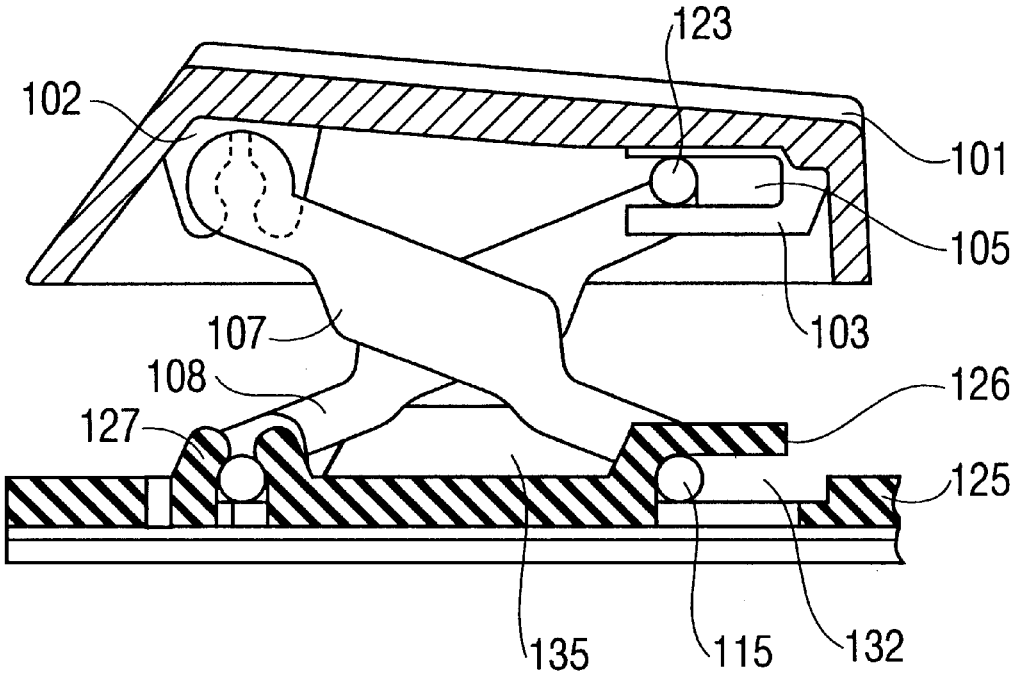
FIG. 6 (PRIOR ART)
FIG. 6 is a sectional view showing a conventional push button switch.

From the condition shown in FIG. 4, when a finger is used to depress the key top 1 the downward pressure is transmitted from support plate 20 to rubber spring 93. As rubber spring 93 is flattened by the pressure, the pantograph assembly folds down into a flat position. The moveable contact inside rubber spring 93 makes contact with the contact in switch substrate 90 and the switch mechanism goes into on condition, as shown in FIG. 5. When the pressure on the key top 1 is released, rubber spring 93 rebounds into its original shape and pushes the pantograph assembly up into the position shown in FIG. 4, where the switch mechanism is in the off condition.

Using a jig to execute the process described above, 80 or more key tops can be easily assembled onto one holder member 40. Referring to FIG. 2, the width between hooks 4 and 5 on key top 1 is approximately the same as the width H of through hole 41 on holder member 40. The assembly procedure for this configuration of push button switch is first to place key top 1 with the symbol side facing down in a preciously prepared tray-shaped holder, and then to mount holder member 40 on top of this.

At this time, hooks 4, 4 and 5, 5 on the underside of key top 1 fit through the through hole 41 of holder member 40 and these hooks position holder member 40 on the jig. A sub assembly is previously made to assemble the pantograph assembly comprising moving frame 60 and moving arm 80 with the support plate 20. This sub assembly is then fitted into holder member 40. This is done by placing support plate 20 of the sub assembly from above holder member 40, aligning the protuberance 7 of key top 1 with round hole 21 of support plate 20 and fitting them into position.

Through this operation, shoulders 23, 25 of plate 20 clip onto hooks 4, 5 of key top 1. Thus attached, plate 20 and key top 1 can now be assembled with holder member 40. Furthermore, with slide pins 62 of moving frame 60 freely held in slide clamps 42 of holder member 40, and with support axis 81 of moving frame 80 pressed into and rotatably supported by axial support clamp 43 of holder member 40, rubber spring 93 positioned on switch substrate 90 is inserted through the through hole 41 of holder member 40 and the switch substrate is aligned with and fixed to the underside of holder member 40 using an appropriate fixing means. With this type of assembly method, the difficult alignment process required by conventional methods is not required, resulting in a simpler and easier assembly, and the easy assembly of smaller push button switches comprising finer components also become easy.

Although the present invention has been described above by way of embodiments thereof, various modifications and applications may be made within the scope of the invention, which modifications and applications are not excluded from the scope of the present invention. For example, the above described push button switch could be configured as a single unit push button switch, and further, the above described rubber spring could be substituted by a compression spring constructed of expanded plastic resin, metal wire or metal sheet, materials which compress when pressure is applied and rebound to their original form when pressure is released.

As described in detail above, in the present invention, when a key top is assembled in one piece together with a support plate, the adjoining surfaces of the key top and support plate form U-shaped grooves, in which grooves the slide pins of the moving arm can rotatably slide.

Further, attaching the slide clamp to the switch substrate forms U-shaped grooves which allow the slide pins of the moving frame fitting into the slide clamps of the holder member to slide freely, thus making the assembly of the pantograph assembly extremely simple. Thus, the conventional assembly process, in which the worker had to fit the slide pins into the U-shaped grooves without being able to see what was happening, is no longer required. Because of this, if a membrane sheet is used for the switch substrate, and the switch substrate comprises a moveable contact installed in the resilient member, separated from the fixed contact, then the assembly of the push button switch is extremely simple compared to conventional designs, and automatic assembly also becomes possible.

Furthermore, in the invention, the effects of the present invention are obtained whether the present invention is used for a single, stand-alone push button switch, or for a plurality of switches in a keyboard assembly. In addition, the effects of the present inventions are obtained whether the resilient member is a rubber spring or a compression spring.

What we claimed is:

1. A push button switch having an operating contact operated by key top, comprising:

a switch substrate which includes the operating contact;

a resilience member closely mounted on the top of said switch substrate;

a holder member 40 which is closely mounted on the top of said switch substrate, having a through hole 41 projected through said resilient member, clamps 42 and axial support clamps 43 formed at a periphery of the through hole 41;

a moving arm 80 having slide pins 83 and support axes 81 which are supported rotatably at said axial support clamps 43;

a moving frame 60 which intersect at said moving arm 80, having support axes 61 and slide pins 62 which are supported slidably at grooves formed between said clamps 42 and said switch substrate;

a support plate 20 having shoulders 25 rotatably support said support axes 61 and slide clamps 22 slidably support said slide pins 62;

a key top holding said support plate 20 at the back.

2. A push button switch according to claim 1, wherein said switch substrate is consisted from a membrane sheet switch mechanism.

3. A push button switch according to claim 1, wherein a movable contact fitted in the resilient member makes and breaks the connection with a fixed contact mounted in said switch substrate.

4. A push button switch according to claim 1, wherein said push button switch consist a single stand-alone switch.

5. A push button switch according to claim 1, wherein said push button switch mechanisms is formed a switch element of keyboard having plural key tops.

6. A push button switch according to claim 1, wherein said resilience member comprises a rubber spring, cup-shaped in cross section, having a click action.

7. A push button switch according to claim 1, wherein said resilience member comprises a spring member which compresses when pressure is applied and returns to its original shape and condition when pressure is released.

* * * * *